US012687379B2

(12) United States Patent
Koekemoer et al.

(10) Patent No.: US 12,687,379 B2
(45) Date of Patent: Jul. 21, 2026

(54) BLAST DETERMINATION SYSTEM

(71) Applicant: Dyno Nobel Limited, Southbank Victoria (AU)

(72) Inventors: Andre L. Koekemoer, Southbank Victoria (AU); Mariusz Talaszewski, Southbank Victoria (AU); Danny Maurissens, Southbank Victoria (AU); Chris Birkin, Southbank Victoria (AU)

(73) Assignee: Dyno Nobel Limited, Southbank (AU)

( * ) Notice: Subject to any disclaimer, the term of this patent is extended or adjusted under 35 U.S.C. 154(b) by 0 days.

(21) Appl. No.: 18/982,980

(22) Filed: Dec. 16, 2024

(65) Prior Publication Data

US 2025/0224219 A1 Jul. 10, 2025

(30) Foreign Application Priority Data

Jan. 8, 2024 (AU) ..... 2024900042

(51) Int. Cl.
*F42D 1/05* (2006.01)
*F42D 3/04* (2006.01)
*F42D 5/02* (2006.01)

(52) U.S. Cl.
CPC ..... *F42D 1/05* (2013.01); *F42D 3/04* (2013.01); *F42D 5/02* (2013.01)

(58) Field of Classification Search
CPC ... F42D 1/00; F42D 1/05; F42D 1/055; F42D 3/04; F42D 5/00; F42D 5/02
USPC ..... 102/217, 301
See application file for complete search history.

(56) References Cited

U.S. PATENT DOCUMENTS

| | | | | |
|---|---|---|---|---|
| 9,587,925 | B2 * | 3/2017 | Garcia | F42D 1/055 |
| 11,215,434 | B2 * | 1/2022 | Torrance | F42D 1/055 |
| 2017/0123087 | A1 * | 5/2017 | Papillon | G01V 1/104 |
| 2020/0309497 | A1 | 10/2020 | Torrance et al. | |
| 2024/0302148 | A1 * | 9/2024 | Kruger | F42D 1/055 |

FOREIGN PATENT DOCUMENTS

WO 2022272315 A1 12/2022

OTHER PUBLICATIONS

International Search Report and Written Opinion dated Jan. 31, 2025 for PCT/AU2024/051296.

* cited by examiner

*Primary Examiner* — James S Bergin
(74) *Attorney, Agent, or Firm* — Dorsey & Whitney LLP

(57) ABSTRACT

The present disclosure provides a system with sensors deployed around a blast site for determining whether each explosive of a blast system has detonated successfully. There is also disclosed a system for determining where the different sensors are to be deployed around the blast site for optimal sensing and data collection using multiple of a sensor or multiple sensors. An aspect of the present disclosure provides a method of determining detonation of explosives of a blast based on a blast plan. The method comprises receiving sensor data from sensors monitoring the blast; pre-processing the received sensor data; and determining outcomes of the blast based on the pre-processed data in correlation with the blast plan.

17 Claims, 6 Drawing Sheets

BLAST DETERMINATION SYSTEM

The present application claims priority to Australian Provisional Patent Application No. 2024900042, filed Jan. 8, 2024, the content of which is incorporated herein by reference in its entirety.

TECHNICAL FIELD

The present invention relates generally to an explosive system and, in particular, to a system for setting up sensors on a blast site and determining whether the explosives in a blast site have successfully detonated. The present invention also relates to a computer program product including a computer readable medium having recorded thereon a computer program for setting up sensors on a blast site, and determining whether the explosives in a blast site have successfully detonated using the sensors in combination with the computer program.

BACKGROUND

Mining involves breaking rock for excavation where the breaking of rocks typically uses explosives. These explosives are arranged and detonated according to a blast plan. However, there are instances where the explosives fail to fire and the misfiring of these explosives create a safety and production hazard. Therefore, there is a need to determine whether all the deployed explosives have detonated successfully. There is also a need to determine whether the explosives have detonated in accordance with the blast plan. This situation is also applicable to underground mining applications.

SUMMARY

It is an object of the present invention to substantially overcome or at least ameliorate one or more of the above disadvantages.

Disclosed are arrangements which seek to address the above problems by providing a system with sensors deployed around a blast site for determining whether each explosive of a blast system has detonated successfully. There is also disclosed a system for determining where the different sensors are to be deployed around the blast site for optimal sensing and data collection using multiple of a sensor or multiple sensors.

According to an aspect of the present disclosure, there is provided a method of determining detonation of explosives of a blast based on a blast plan, the method comprising: receiving sensor data from sensors monitoring the blast; pre-processing the received sensor data; and determining outcomes of the blast based on the pre-processed data in correlation with the blast plan.

According to another aspect of the present disclosure, there is provided a system of determining detonation of explosives of a blast based on a blast plan, the system comprising: a computer system; sensors in communication with the computer system; wherein the computer system includes a computer program that is executable by the computer system such that, when executed, the computer system performs the method described above.

According to another aspect of the present disclosure, there is provided a computer program product including a computer readable medium having recorded thereon a computer program for implementing any one of the methods described above.

Other aspects are also disclosed.

BRIEF DESCRIPTION OF THE DRAWINGS

At least one embodiment of the present invention will now be described with reference to the drawings, in which.

DETAILED DESCRIPTION

Figure 1:
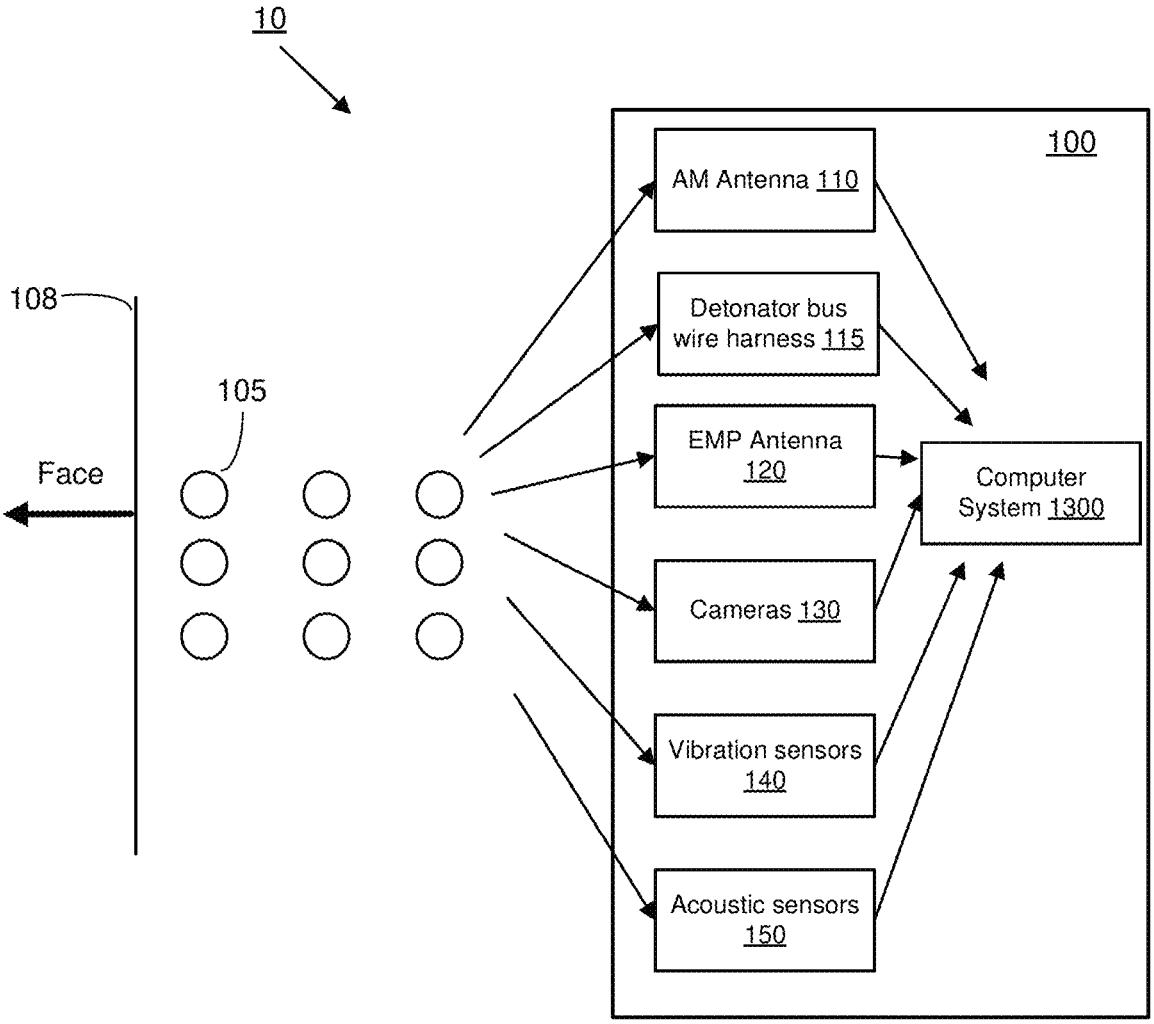
FIG. 1 shows an arrangement of a blast site using a system according to the present disclosure.

Where reference is made in any one or more of the accompanying drawings to steps and/or features, which have the same reference numerals, those steps and/or features have for the purposes of this description the same function(s) or operation(s), unless the contrary intention appears.

FIG. 1 shows a blasting site 10 where bench blasting is to be performed. FIG. 1 shows the blasting site 10 has boreholes 105 and a face 108. Further, explosives (not shown) are disposed within the boreholes 105 and the explosives are to be detonated in accordance with a blast plan. A blast plan comprises borehole data, blasting site data, and detonation information.

Borehole data may include borehole parameters such as borehole spacing, borehole burden, borehole depth, borehole diameter, borehole pattern layout, the number of boreholes, stemming information, explosive properties, borehole angle, top coordinates of the borehole, bottom coordinates of the borehole, and decking information. Borehole pattern layout may be geometrically defined in a 3D coordinate system, X (longitude), Y (latitude) and Z (vertical). The 3D coordinate system may be local with an origin somewhere close to the blast pattern, or, may be in the coordinate system of the mine, which is typically a larger 3D local coordinate system that encompasses all of the mine. In a blast pattern design a line representing the borehole may be defined by the top and bottom coordinates.

Blasting site data may include information relating to the blasting site 10 such as bench information, geological properties, geologic characteristics, geologic factors, weather forecast, and three-dimensional (3D) geometrical model of the blasting site 10. Non-limiting examples of bench information includes face angle, bench height, bench dip, pit dip, spoil angle, and a number of face elements. Non-limiting examples of geological properties include mineralogy (elemental and/or mineral), lithologic structure (primary, secondary, and/or texture), porosity, hardness, attenuation, Young's Modulus, Shear Modulus, Bulk Modulus, Poisson Ratio, P wave velocity, S wave velocity, rock density, rock type, rock strength, rock conditions, rock description, joint condition, joint angle, joint orientation, standard deviation of joint spacing, cohesion, vertical joint spacing, horizontal joint spacing, unconfined compressive strength (UCS), sonic velocity, standard deviation of drilling, shock velocity, fracture toughness of rock, reflectivity of rock, tensile strength of rock, internal friction angle, Hugoniot data (e.g., Up min, Up max, Us min, Us max), and ground stresses (σ1, σ2, σ3, stress orientation, dip, direction, and roll). "Texture" refers to the size, shape, and arrangement of the interlocking mineral crystals which form a rock or other material. The geology data may be used to determine further geologic characteristics, such as friability and fragmentability. The weather forecast at the blasting site 10 (at the time which the blasting is to be conducted) may include wind direction, wind strength, temperature, precipitation, humidity, and air pressure.

Detonation information may include the blast pattern and the timing information (e.g., timing delay) for triggering the explosives disposed in the respective boreholes 105.

FIG. 1 also shows an explosive monitoring system 100 having different sensors, such as AM antenna 110, detonator bus wire harness 115, EMP antenna 120, cameras 130, vibration sensors 140, and acoustic sensors 150. The sensors 110 to 150 capture different parameters relating to the detonation of the explosives in the boreholes 105. The sensors 110 to 150 are then connected to a computer system 1300, which also receives the blast plan of the blasting site 10. The computer system 1300 then processes the blast plan with the available sensors 110 to 150 to determine the optimal locations of the sensors 110 to 150. In one arrangement, the computer system 1300 adjusts the timing delay between explosives to enable the sensors 110 to 150 to better detect whether the explosives have successfully detonated. The method for determining sensor set-up and blast plan adjustments is described hereinafter in relation to FIG. 2.

When the explosives are detonated according to the blast plan, the sensors 110 to 150 provide the detected parameters to the computer system 1300. The computer system 1300 in turn processes the parameters captured by the sensors 110 to 150 to determine whether the explosives in the boreholes 105 have detonated successfully and to determine whether the explosives detonated in accordance with the blast plan. The method for determining the detonation of the explosives will be described hereinafter in relation to FIG. 3.

The AM antennas 110 are configured for detecting electrical and magnetic fields. The detected electrical and magnetic fields can then be processed to determine an explosion occurring at a borehole 105.

The EMP antennas 120 (which, in one example, is a wire antenna) and/or detonator bus wire harness 115 are configured for detecting electromagnetic pulses that are generated when an explosive is detonated. WO 2019/071304 A1, the content of which is incorporated herein by reference, describes one arrangement for detecting electromagnetic pulses and processing the detected electromagnetic pulses. The detected electromagnetic pulses can then be processed to determine an explosion occurring at a borehole 105.

The cameras 130 are configured to capture videos of the explosions, for example the burning front of the explosives. The cameras 130 may be disposed at fixed locations around the blasting site 10 or at drones flying above the blasting site 10. When an explosion occurs at a borehole 105, a puff of dust can be seen at the borehole 105. The cameras 130 capture the puff of dust and associates the puff of dust with a detonation of an explosive at that particular location. Accordingly, the captured videos can be processed to determine an explosion occurring at a borehole 105. In another arrangement, the cameras 130 capture an image of the collar of one of the boreholes 105. At the moment of the explosion, the collar changes shape, form, be deformed, start to move, and the like. The captured videos can be processed to determine an explosion occurring at a borehole 105 when such deformation or movement is detected. In another arrangement, a marker is placed at or in the proximity of the borehole 105 or randomly disposed around the boreholes 105 to assist in determining movement at or near the borehole 105.

The vibration sensors 140 are configured for detecting vibration occurring at the blasting site 10. When an explosion occurs at a borehole 105, the explosion causes a vibration that is detected by the vibration sensors 140, which are located around the blasting site 10. In turn, the detected vibration is processed to determine where the explosion occurs, which can then be associated with an explosion occurring at a particular borehole 105.

The acoustic sensors 150 (e.g., microphones) are configured for detecting the sound at the blasting site 10. When an explosion occurs at a borehole 105, the explosion causes a particular sound signature that is identifiable. The acoustic sensors capture the sound and in turn a processor determines whether the captured sound relates to an explosion. The amplitude of the captured sound signature also provides information as to the distance between the explosion and the acoustic sensors 150. Accordingly, the detected sound can be used to determine an explosion that occurs at a particular borehole 105.

There is a level of uncertainty attributed to the information captured by any one of the sensors 110 to 150. For example, the vibration sensors 140 captured a sound signature which has been slightly distorted and/or the amplitude of that sound signature is weak, the processing of that sound signature then determines that, based on the detected sound signature, the chances of an explosion occurring at a particular borehole 105 are 40%. In another example, one of the cameras 130 captured a puff of dust at a borehole 105 but the image is obstructed by dust produced by other boreholes 105. The processor therefore determines that the chances of an explosion occurring at that particular borehole 105 are 60%. Similar chances are provided by the processor when processing the information captured by any of the other sensors 110 to 150.

A combination of the captured information by two or more of the sensors 110 to 150 is used to provide a more accurate determination as to the detonation of an explosive at a particular borehole 105.

Although the present invention is shown for monitoring bench blasting, a skilled person would understand that the present invention may be used on other types of blasting and on other environments (e.g., underground mining).

Figure 2:
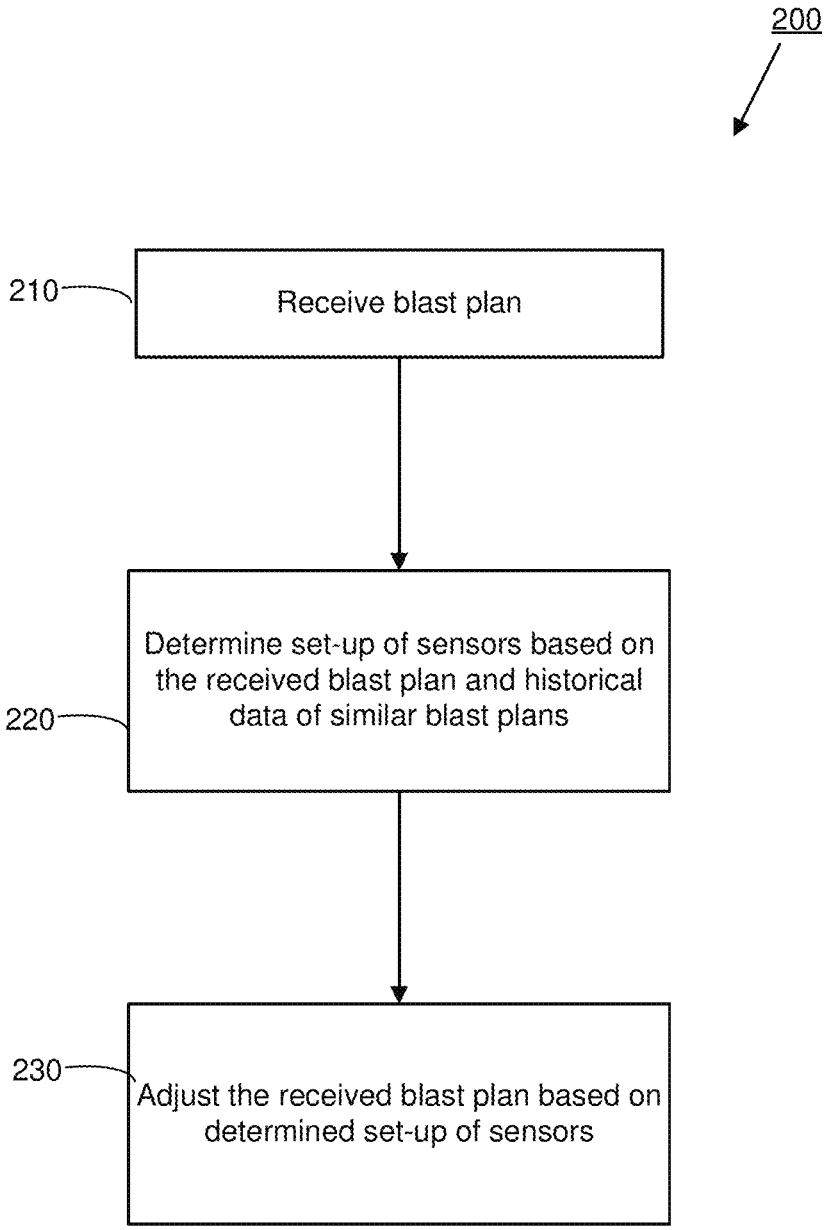
FIG. 2 is a flow diagram of a method of determining the set-up of sensors and adjusting a blast plan according to the present disclosure.

FIG. 2 shows a method 200 for determining the set-up of the sensors 110 to 150 and for adjusting the blast plan. The method 200 is implemented as one or more software application programs 1333 executable within the computer system 1300.

The method 200 commences in step 210 by receiving the blast plan. In one arrangement, the blast plan is prepared in a software application executed by the computer system 1300. In another arrangement, the blast plan is prepared in software executed by another computer system (not shown), which then transmits the blast plan to the computer system 1300. The method 200 then proceeds from step 210 to step 220.

In step 220, the method 200 determines the set-up of the sensors 110 to 150 using the received blast plan and the historical data of other similar blast plans. The historical data provide guidance as to the set-ups of the sensors 110 to 150 that successfully/unsuccessfully captured information in determining whether an explosion occurred at a borehole. In one example, a blasting site is predicted to have wind blowing in the direction of North to South. Previous data indicated that such wind would obscure the video captured by a camera located northward of the blasting site, if the burning front of the blast plan moves from North to South. This is due to the dust generated by the explosives detonated at the beginning of the blast plan obstructing the view of the North placed camera. Accordingly, the method 200 would set up the cameras 130 at other locations (e.g., West, East, South) in view of the circumstances.

In one arrangement, some of the sensors 110 to 150 (excluding detonator bus wire harness 115) are disposed on drones. In this arrangement, the set-up of the sensors 110 to 150 includes flight plans of the different drones.

The method 200 then proceeds from step 220 to step 230.

In step 230, the method 200 adjusts the received blast plan based on the determined set-up of the sensors 110 to 150. The adjustments performed on the blast plan are to improve the detection of parameters by the sensors 110 to 150 while substantially maintaining the blast pattern and timing information of the explosives to achieve the required objective. In one arrangement, the blast plan includes a range of timing delays for a particular borehole 105 and the method 200 only adjusts the timing delays within the range allowable by the blast plan.

The method 200 concludes at the conclusion of step 230.

The user then implements the adjusted blast plan at the blasting site 10. When the adjusted blast plan is executed, the sensors 110 to 150 detect the respective parameters (e.g., vibration, acoustic, EMP, etc.) and provide the detected parameters to the computer system 1300.

Figure 3:
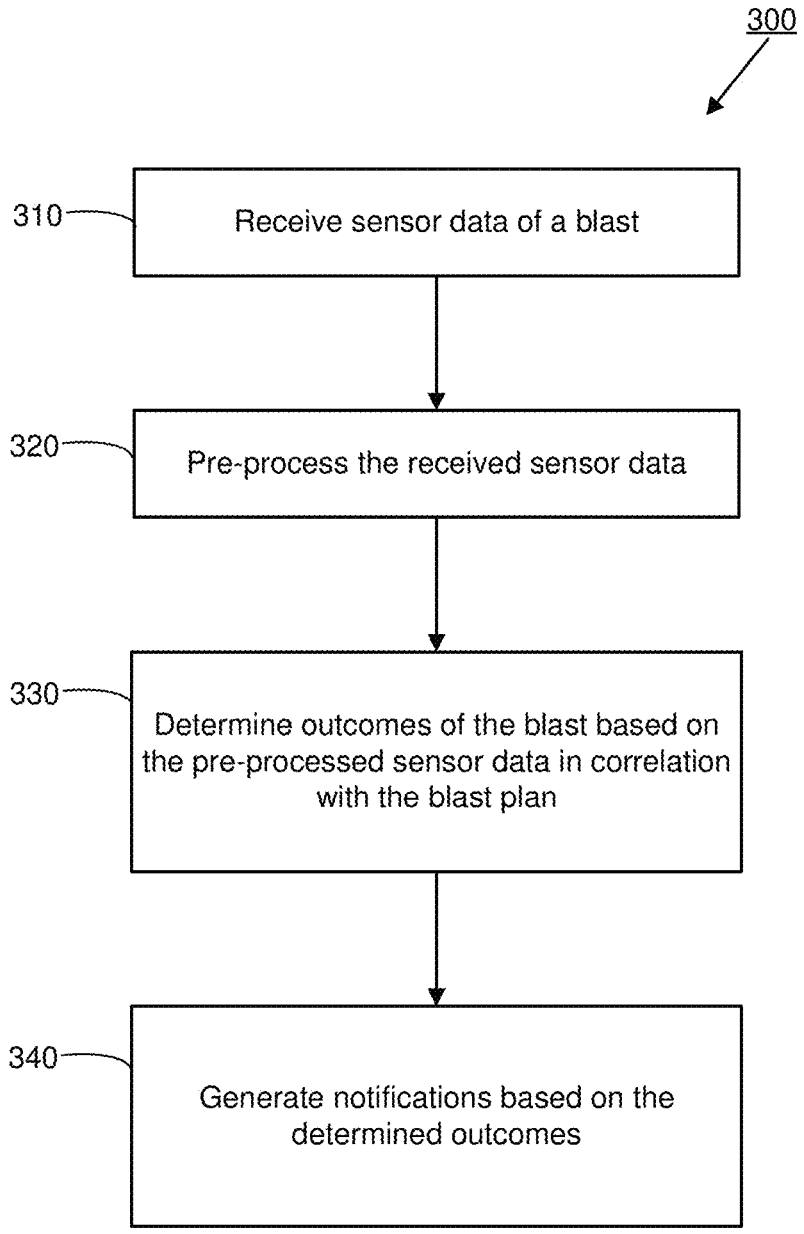
FIG. 3 is a flow diagram of a method of determining the detonation of explosives deployed on a blast site according to the present disclosure.

FIG. 3 shows a method 300 for determining whether the explosives in the boreholes 105 have detonated successfully. The method 300 is implemented as one or more software application programs 1333 executable within the computer system 1300.

The method 300 commences in step 310 by receiving sensor data of a blast at the blasting site 10. The sensor data is captured by the respective sensors 110 to 150. The method 300 receives the sensor data in real-time or in files with time stamps. The method 200 then proceeds from step 310 to step 320.

In step 320, the method 300 pre-processes the received sensor data. The pre-processing step commences by correlating and aligning the received sensor data to the same time domain. First, one of the sensor data is selected as the reference sensor data. Second, the sensor data from another sensor is then overlaid on the reference sensor data to achieve optimum alignment of the two data sets. This process is repeated for other sensor data until all sensor data sets are aligned. The alignment of the sensor data sets includes backward and forward alignment, meaning time going forward or backward. In one example, sensor data from one of the sensors is processed to determine that an explosion at a borehole 105 occurs at time t and an explosion occurs at another borehole 105 at time t+1. Another sensor data from another sensor is also determined to provide the same set of explosions. The two sensor data sets can then be matched accordingly. For example, the pre-processing determines whether the cameras 130 capture videos of dust puff at the respective boreholes 105 at a particular time. The pre-processing also includes determining whether each sensor 110 to 150 detects an explosion at a particular borehole 105. These determinations are then used to align the sensor data.

The data sets of any sensor would be unlikely to be fully complete (i.e., does not show each blast hole firing definitively and there are "gaps/voids" in the data. The third step in the alignment process is to fill in the gaps in the total sensor data set. The third step therefore combines the sensor data from all of the sensors to achieve an optimised and full data set of the blast. The third step includes using the blast plan as a basis for the consolidation of the sensor data in that the blast plan provides estimates as to the period of time in which the valid data should fall. The above discussed alignment of sensor data does not rely on a synchronous "time zero." In one arrangement, synchronous time stamps may be provided on the sensor data. If such synchronous time stamps are provided on the sensor data, then alignment of the sensor data is achieved using the synchronous time stamps.

There are other pre-processing steps that are optional that may be performed on certain sensor data. The optional pre-processing steps may convert the received sensor data into a particular format, filter the received sensor data (e.g., frequency filter, image filter, etc.), and the like. Such pre-processing may remove noises, irrelevant information, and the like. The method 300 then proceeds from step 320 to step 330.

In step 330, the method 300 determines the outcomes of the blast based on the pre-processed data (i.e., aligned sensor data) in correlation with the blast plan. The method 300 compares the parameters detected by the sensors 110 to 150 against the adjusted blast plan. The comparison provides a confirmation whether an explosive at a particular borehole 105 detonates successfully. From the data obtained in similar mine sites, or blasts in the database, the system further attempts to assign cause(s) to the anomalies or misfires. The information can then be used into the design rules of future blast plans.

The method 300 then proceeds from step 330 to step 340.

In step 340, the method 300 generates notifications based on the determined outcomes. The notifications may include confirmation of the timing delays between explosives in the respective boreholes 105, the speed of the burning front, discrepancies between the blast plan and the actual blast, unsuccessful detonation of explosives in the boreholes 105, and the like.

The method 300 concludes at the conclusion of step 340.

Each of the methods 200 and 300 may use artificial intelligence to perform each of the steps shown in FIGS. 2 and 3. Artificial intelligence is implemented by using neural networks, examples of which include a feedforward neural network and a recurrent neural network.

Figure 4:
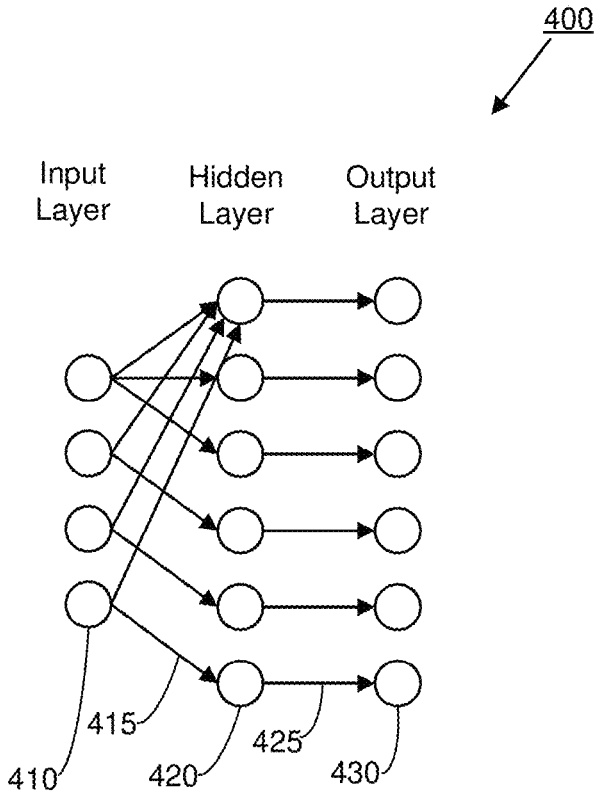
FIG. 4 is a schematic block diagram of a neural network for performing the methods of FIGS. 2 and 3.

FIG. 4 shows a feedforward neural network 400 configured for receiving input data (e.g., the blast plan), processing the input data, and outputting the results (i.e., the outputs of the methods 200 and 300). The feedforward neural network 400 has an input layer with neurons 410, a hidden layer with neurons 420, and an output layer with neurons 430. Although only one hidden layer is shown, the feedforward neural network 400 may employ two or more hidden layers to process the input data. For ease of reference hereinafter, the reference numeral 410 will be used to denote the input layer or the neurons of the input layer, the reference numeral 420 will be used to denote the hidden layer or the neurons of the hidden layer, and the reference numeral 430 will be used to denote the output layer or the neurons of the output layer.

The feedforward neural network 400 also includes connections 415 from the input layer 410 to the hidden layer 420, connections 425 from the hidden layer 420 (or the last hidden layer when there are multiple hidden layers) to the output layer 430. When there are multiple hidden layers 420, then there are also connections connecting the neurons from a previous hidden layer to the neurons of a subsequent hidden layer.

The connections 415 includes weighting so that the data received at a neuron of the input layer 410 is weighted when transmitted to a neuron of the hidden layer 420. Similarly, connections connecting a previous hidden layer to a subsequent hidden layer includes weighting so data provided by a neuron of a previous hidden layer is weighted when transmitted to a neuron of a subsequent hidden layer.

For executing the method 200, the feedforward neural network 400 with hidden layers 420 are programmed to execute steps 220 and 230 of the method 200. Each neuron in the input layer 410 receives each parameter of the borehole data, blasting site data, and detonation information (described above in relation to step 210). The connections 415 then weight and transmit each parameter to one or more neurons 420 of the hidden layer. The one or more neurons 420 of the hidden layer then receive and process the parameters from the input layer 410 using an activation function built into each neuron 420. An activation function is a weighted sum of the input connections. The neurons 420 of the hidden layer then output the processed parameters. If more than one hidden layer is used, the processed parameters of each neuron of the hidden layer are further weighted and transmitted to the neurons of the next hidden layer, which in turn process the input connections using the respective neuron's activation function. This process continues until all the hidden layers have processed the parameters. The last hidden layer then provides the processed parameters to the output layer 430.

Similar to programming the steps of the method 200, the hidden layer 420 is programmed for executing steps 320 to 340 of the method 300. The process within the feedforward neural network 400 is similar as described above. In this case, the neurons of the input layer 410 receive and process the adjusted blast data together with the parameters detected by the sensors 110 to 150 (described above in relation to step 310).

The neurons 420 of the hidden layer need to be trained to perform the steps of the methods 200 and 300. Initially, the feedforward neural network 400 is trained by using a training data set that has been confirmed to provide the correct output based on certain input. As each training data is fed into the feedforward neural network 400, the feedforward neural network 400 adjusts the weights of the connections 415, 425 and of the activation function within the neurons 420. After each adjustment, a delta function determines the error between the output of the feedforward neural network 400 and the training data set. This process is then repeated until the error becomes negligible.

Other types of machine learning or artificial intelligence programs may be used instead of the neural network shown in FIG. 4 to implement the system shown in FIGS. 1 to 3.

Computer Description

Figure 5A:
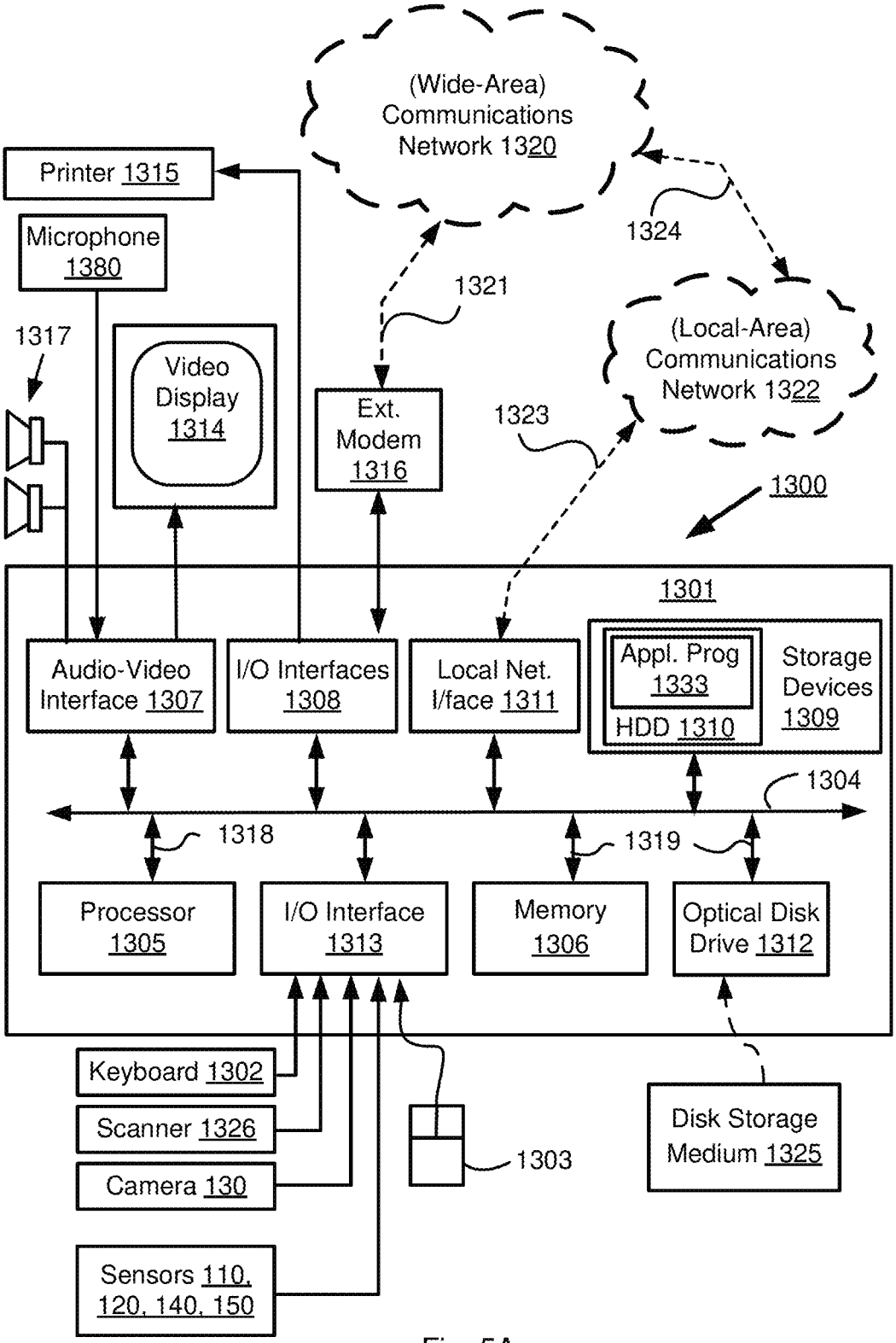
FIGS. 5A and 5B form a schematic block diagram of a general purpose computer system upon which arrangements described can be practiced.
Figure 5B:
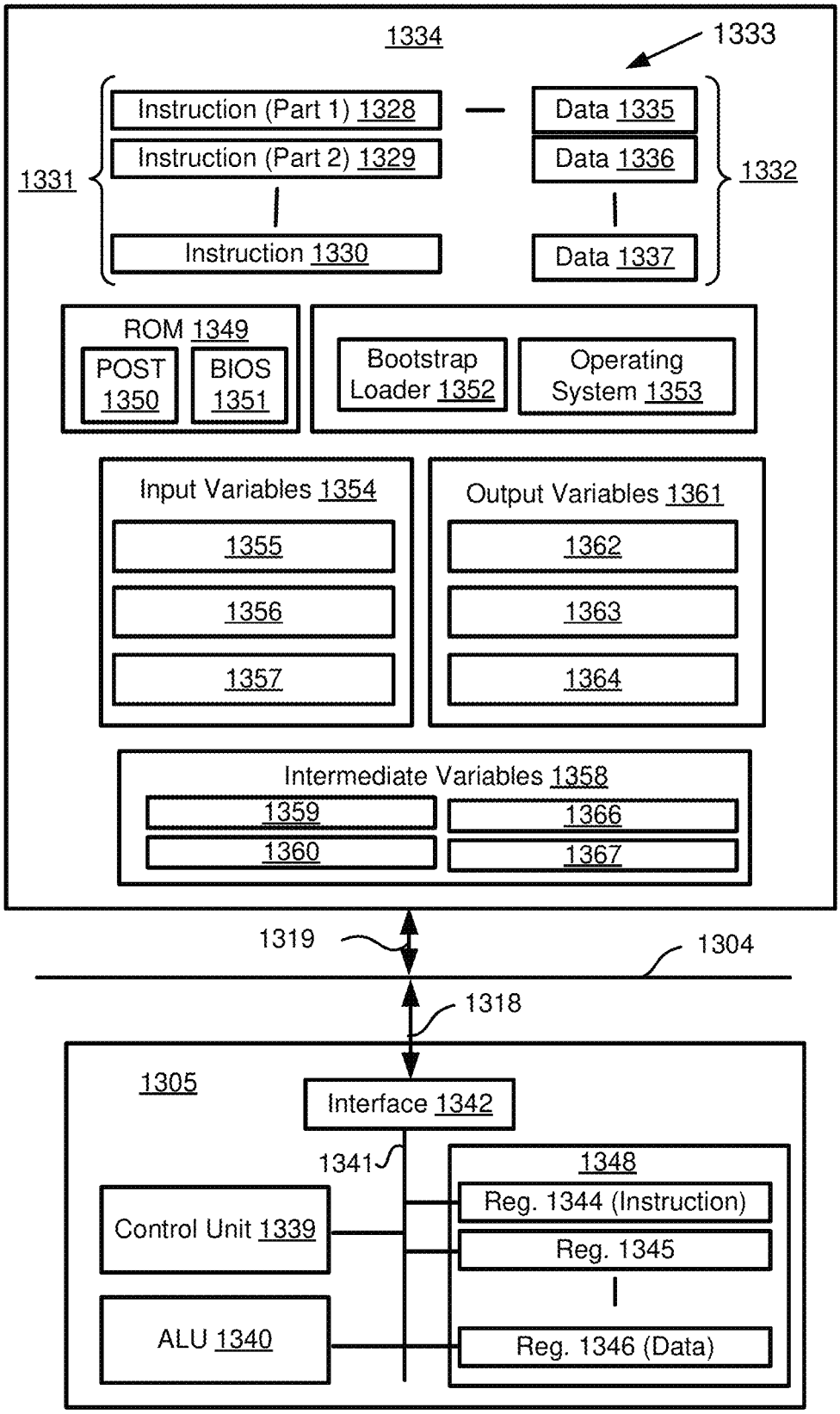

FIGS. 5A and 5B depict a general-purpose computer system 1300, upon which the various arrangements described can be practiced.

As seen in FIG. 5A, the computer system 1300 includes: a computer module 1301; input devices such as a keyboard 1302, a mouse pointer device 1303, a scanner 1326, the cameras 130, and a microphone 1380; and output devices including a printer 1315, a display device 1314 and loudspeakers 1317. An external Modulator-Demodulator (Modem) transceiver device 1316 may be used by the computer module 1301 for communicating to and from a communications network 1320 via a connection 1321. The communications network 1320 may be a wide-area network (WAN), such as the Internet, a cellular telecommunications network, or a private WAN. Where the connection 1321 is a telephone line, the modem 1316 may be a traditional "dial-up" modem. Alternatively, where the connection 1321 is a high capacity (e.g., cable) connection, the modem 1316 may be a broadband modem. A wireless modem may also be used for wireless connection to the communications network 1320.

The computer module 1301 typically includes at least one processor unit 1305, and a memory unit 1306. For example, the memory unit 1306 may have semiconductor random access memory (RAM) and semiconductor read only memory (ROM). The computer module 1301 also includes an number of input/output (I/O) interfaces including: an audio-video interface 1307 that couples to the video display 1314, loudspeakers 1317 and microphone 1380; an I/O interface 1313 that couples to the keyboard 1302, mouse 1303, scanner 1326, cameras 130, the sensors 110, 120, 140, 150 and optionally a joystick or other human interface device (not illustrated); and an interface 1308 for the external modem 1316 and printer 1315. In some implementations, the modem 1316 may be incorporated within the computer module 1301, for example within the interface 1308. The computer module 1301 also has a local network interface 1311, which permits coupling of the computer system 1300 via a connection 1323 to a local-area communications network 1322, known as a Local Area Network (LAN). As illustrated in FIG. 5A, the local communications network 1322 may also couple to the wide network 1320 via a connection 1324, which would typically include a so-called "firewall" device or device of similar functionality. The local network interface 1311 may comprise an Ethernet circuit card, a Bluetooth® wireless arrangement or an IEEE 802.11 wireless arrangement; however, numerous other types of interfaces may be practiced for the interface 1311. In one alternative arrangement, the sensors 110 to 150 may be connected to the computer system 1300 via the LAN 1322 or the WAN 1320.

The I/O interfaces 1308 and 1313 may afford either or both of serial and parallel connectivity, the former typically being implemented according to the Universal Serial Bus (USB) standards and having corresponding USB connectors (not illustrated). Storage devices 1309 are provided and typically include a hard disk drive (HDD) 1310. Other storage devices such as a floppy disk drive and a magnetic tape drive (not illustrated) may also be used. An optical disk drive 1312 is typically provided to act as a non-volatile source of data. Portable memory devices, such optical disks (e.g., CD-ROM, DVD, Blu-ray Disc™), USB-RAM, portable, external hard drives, and floppy disks, for example, may be used as appropriate sources of data to the system 1300.

The components 1305 to 1313 of the computer module 1301 typically communicate via an interconnected bus 1304 and in a manner that results in a conventional mode of operation of the computer system 1300 known to those in the relevant art. For example, the processor 1305 is coupled to the system bus 1304 using a connection 1318. Likewise, the memory 1306 and optical disk drive 1312 are coupled to the system bus 1304 by connections 1319. Examples of computers on which the described arrangements can be practised include IBM-PC's and compatibles, Sun Sparcstations, Apple Mac™ or like computer systems.

The methods 200 and 300 of determining the set-up of the sensors 110 to 150, adjusting the blast plane, and determining whether the explosives at the blasting site have detonated successfully may be implemented using the computer system 1300 wherein the processes of FIGS. 2 and 3, described above, may be implemented as one or more software application programs 1333 executable within the computer system 1300. In particular, the steps of the methods 200 and 300 are effected by instructions 1331 (see FIG. 5B) in the software 1333 that are carried out within the computer system 1300. The software instructions 1331 may be formed as one or more code modules, each for performing one or more particular tasks. The software may also be divided into two separate parts, in which a first part and the corresponding code modules performs the described methods and a second part and the corresponding code modules manage a user interface between the first part and the user.

The software may be stored in a computer readable medium, including the storage devices described below, for example. The software is loaded into the computer system 1300 from the computer readable medium, and then executed by the computer system 1300. A computer readable medium having such software or computer program recorded on the computer readable medium is a computer program product. The use of the computer program product in the computer system 1300 preferably effects an advantageous apparatus for determining the set-up of the sensors 110 to 150 at a blasting site 10, adjusting the blast plan of the blasting site 10, and determining whether the explosives in the boreholes 105 of the blasting site 10 have detonated successfully.

The software 1333 is typically stored in the HDD 1310 or the memory 1306. The software is loaded into the computer system 1300 from a computer readable medium, and executed by the computer system 1300. Thus, for example, the software 1333 may be stored on an optically readable disk storage medium (e.g., CD-ROM) 1325 that is read by the optical disk drive 1312. A computer readable medium having such software or computer program recorded on it is a computer program product. The use of the computer program product in the computer system 1300 preferably effects an apparatus for determining the set-up of the sensors 110 to 150 at a blasting site 10, adjusting the blast plan of the blasting site 10, and determining whether the explosives in the boreholes 105 of the blasting site 10 have detonated successfully.

In some instances, the application programs 1333 may be supplied to the user encoded on one or more CD-ROMs 1325 and read via the corresponding drive 1312, or alternatively may be read by the user from the networks 1320 or 1322. Still further, the software can also be loaded into the computer system 1300 from other computer readable media. Computer readable storage media refers to any non-transitory tangible storage medium that provides recorded instructions and/or data to the computer system 1300 for execution and/or processing. Examples of such storage media include floppy disks, magnetic tape, CD-ROM, DVD, Blu-Ray™ Disc, a hard disk drive, a ROM or integrated circuit, USB memory, a magneto-optical disk, or a computer readable card such as a PCMCIA card and the like, whether or not such devices are internal or external of the computer module 1301. Examples of transitory or non-tangible computer readable transmission media that may also participate in the provision of software, application programs, instructions and/or data to the computer module 1301 include radio or infra-red transmission channels as well as a network connection to another computer or networked device, and the Internet or Intranets including e-mail transmissions and information recorded on Websites and the like.

The second part of the application programs 1333 and the corresponding code modules mentioned above may be executed to implement one or more graphical user interfaces (GUIs) to be rendered or otherwise represented upon the display 1314. Through manipulation of typically the keyboard 1302 and the mouse 1303, a user of the computer system 1300 and the application may manipulate the interface in a functionally adaptable manner to provide controlling commands and/or input to the applications associated with the GUI(s). Other forms of functionally adaptable user interfaces may also be implemented, such as an audio interface utilizing speech prompts output via the loudspeakers 1317 and user voice commands input via the microphone 1380.

FIG. 5B is a detailed schematic block diagram of the processor 1305 and a "memory" 1334. The memory 1334 represents a logical aggregation of all the memory modules (including the HDD 1309 and semiconductor memory 1306) that can be accessed by the computer module 1301 in FIG. 5A.

When the computer module 1301 is initially powered up, a power-on self-test (POST) program 1350 executes. The POST program 1350 is typically stored in a ROM 1349 of the semiconductor memory 1306 of FIG. 5A. A hardware device such as the ROM 1349 storing software is sometimes referred to as firmware. The POST program 1350 examines hardware within the computer module 1301 to ensure proper functioning and typically checks the processor 1305, the memory 1334 (1309, 1306), and a basic input-output systems software (BIOS) module 1351, also typically stored in the ROM 1349, for correct operation. Once the POST program 1350 has run successfully, the BIOS 1351 activates the hard disk drive 1310 of FIG. 5A. Activation of the hard disk drive 1310 causes a bootstrap loader program 1352 that is resident on the hard disk drive 1310 to execute via the processor 1305. This loads an operating system 1353 into the RAM memory 1306, upon which the operating system 1353 commences operation. The operating system 1353 is a system level application, executable by the processor 1305, to fulfil various high level functions, including processor management, memory management, device management, storage management, software application interface, and generic user interface.

The operating system 1353 manages the memory 1334 (1309, 1306) to ensure that each process or application running on the computer module 1301 has sufficient memory in which to execute without colliding with memory allocated to another process. Furthermore, the different types of memory available in the system 1300 of FIG. 5A must be used properly so that each process can run effectively. Accordingly, the aggregated memory 1334 is not intended to illustrate how particular segments of memory are allocated (unless otherwise stated), but rather to provide a general view of the memory accessible by the computer system 1300 and how such is used.

As shown in FIG. 5B, the processor 1305 includes a number of functional modules including a control unit 1339, an arithmetic logic unit (ALU) 1340, and a local or internal memory 1348, sometimes called a cache memory. The cache memory 1348 typically includes a number of storage registers 1344-1346 in a register section. One or more internal busses 1341 functionally interconnect these functional modules. The processor 1305 typically also has one or more interfaces 1342 for communicating with external devices via the system bus 1304, using a connection 1318. The memory 1334 is coupled to the bus 1304 using a connection 1319.

The application program 1333 includes a sequence of instructions 1331 that may include conditional branch and loop instructions. The program 1333 may also include data 1332 which is used in execution of the program 1333. The instructions 1331 and the data 1332 are stored in memory locations 1328, 1329, 1330 and 1335, 1336, 1337, respectively. Depending upon the relative size of the instructions 1331 and the memory locations 1328-1330, a particular instruction may be stored in a single memory location as depicted by the instruction shown in the memory location 1330. Alternately, an instruction may be segmented into a number of parts each of which is stored in a separate memory location, as depicted by the instruction segments shown in the memory locations 1328 and 1329.

In general, the processor 1305 is given a set of instructions which are executed therein. The processor 1305 waits for a subsequent input, to which the processor 1305 reacts to by executing another set of instructions. Each input may be provided from one or more of a number of sources, including data generated by one or more of the input devices 1302, 1303, data received from an external source across one of the networks 1320, 1302, data retrieved from one of the storage devices 1306, 1309 or data retrieved from a storage medium 1325 inserted into the corresponding reader 1312, all depicted in FIG. 5A. The execution of a set of the instructions may in some cases result in output of data. Execution may also involve storing data or variables to the memory 1334.

The disclosed arrangements use input variables 1354, which are stored in the memory 1334 in corresponding memory locations 1355, 1356, 1357. The arrangements produce output variables 1361, which are stored in the memory 1334 in corresponding memory locations 1362, 1363, 1364. Intermediate variables 1358 may be stored in memory locations 1359, 1360, 1366 and 1367.

Referring to the processor 1305 of FIG. 5B, the registers 1344, 1345, 1346, the arithmetic logic unit (ALU) 1340, and the control unit 1339 work together to perform sequences of micro-operations needed to perform "fetch, decode, and execute" cycles for every instruction in the instruction set making up the program 1333. Each fetch, decode, and execute cycle comprises:

- a fetch operation, which fetches or reads an instruction 1331 from a memory location 1328, 1329, 1330;
- a decode operation in which the control unit 1339 determines which instruction has been fetched; and
- an execute operation in which the control unit 1339 and/or the ALU 1340 execute the instruction.

Thereafter, a further fetch, decode, and execute cycle for the next instruction may be executed. Similarly, a store cycle may be performed by which the control unit 1339 stores or writes a value to a memory location 1332.

Each step or sub-process in the processes of FIGS. 2 and 3 is associated with one or more segments of the program 1333 and is performed by the register section 1344, 1345, 1347, the ALU 1340, and the control unit 1339 in the processor 1305 working together to perform the fetch, decode, and execute cycles for every instruction in the instruction set for the noted segments of the program 1333.

The methods 200 and 300 may alternatively be implemented in dedicated hardware such as one or more integrated circuits performing the functions or sub functions described in relation to the methods 200 and 300. Such dedicated hardware may include graphic processors, digital signal processors, or one or more microprocessors and associated memories.

INDUSTRIAL APPLICABILITY

The arrangements described are applicable to the computer and data processing industries and particularly for determining the set-up of the sensors 110 to 150 at a blasting site 10, adjusting the blast plan of the blasting site 10, and determining whether the explosives in the boreholes 105 of the blasting site 10 have detonated successfully.

The foregoing describes only some embodiments of the present invention, and modifications and/or changes can be made thereto without departing from the scope and spirit of the invention, the embodiments being illustrative and not restrictive.

In the context of this specification, the word "comprising" means "including principally but not necessarily solely" or "having" or "including", and not "consisting only of". Variations of the word "comprising", such as "comprise" and "comprises" have correspondingly varied meanings.

The invention claimed is:

1. A method of determining detonation of explosives of a blast based on a blast plan, the method comprising:

receiving sensor data from sensors monitoring the blast;

pre-processing the received sensor data, wherein the pre-processing includes filling in missing data in one sensor data based on other sensor data and an estimate provided by the blast plan; and determining outcomes of the blast based on the pre-processed data in correlation with the blast plan.

2. The method according to claim 1, wherein the pre-processing step includes aligning the sensor data of a sensor to another sensor data of another sensor.

3. The method according to claim 2, wherein the aligning step includes selecting one of the sensor data as reference sensor data and aligning other sensor data to the reference sensor data.

4. The method according to claim 1, wherein the pre-processing further includes converting the received sensor data into a particular format or filtering the received sensor data.

5. The method according to claim 1, wherein the method further comprises generating a notification based on the determined outcomes of the blast.

6. The method according to claim 5, wherein the notification includes confirmation of timing delays between the explosives, speed of a burning front of the explosives, discrepancies between the blast plan and the actual blast, and/or unsuccessful detonation of the explosives.

7. A computer program recorded on a computer readable medium, wherein the computer program is executable by a computer system to perform a method of determining detonation of explosives of a blast based on a blast plan, the method comprising:

receiving sensor data from sensors monitoring the blast;

pre-processing the received sensor data, wherein the pre-processing includes filling in missing data in one sensor data based on other sensor data and an estimate provided by the blast plan; and determining outcomes of the blast based on the pre-processed data in correlation with the blast plan.

8. The computer program of claim 7, wherein the pre-processing step includes aligning the sensor data of a sensor to another sensor data of another sensor.

9. The computer program of claim 8, wherein the aligning step includes selecting one of the sensor data as reference sensor data and aligning other sensor data to the reference sensor data.

10. The computer program of claim 7, wherein the pre-processing further includes converting the received sensor data into a particular format or filtering the received sensor data.

11. The computer program of claim 7, wherein the method further comprises generating a notification based on the determined outcomes of the blast, wherein the notification includes confirmation of timing delays between the explosives, speed of a burning front of the explosives, discrepancies between the blast plan and the actual blast, and/or unsuccessful detonation of the explosives.

12. A system of determining detonation of explosives of a blast based on a blast plan, the system comprising:

a computer system;

sensors in communication with the computer system;

wherein the computer system includes a computer program that is executable by the computer system such that, when executed, the computer system performs a method of determining detonation of explosives of a blast based on a blast plan, the method comprising:

receiving sensor data from sensors monitoring the blast;

pre-processing the received sensor data, wherein the pre-processing includes filling in missing data in one sensor data based on other sensor data and an estimate provided by the blast plan; and determining outcomes of the blast based on the pre-processed data in correlation with the blast plan.

13. The system of claim 12, wherein the pre-processing step includes aligning the sensor data of a sensor to another sensor data of another sensor.

14. The system of claim 13, wherein the aligning step includes selecting one of the sensor data as reference sensor data and aligning other sensor data to the reference sensor data.

15. The system of claim 12, wherein the pre-processing further includes converting the received sensor data into a particular format or filtering the received sensor data.

16. The system of claim 12, wherein the method further comprises generating a notification based on the determined outcomes of the blast.

17. The system of claim 16, wherein the notification includes confirmation of timing delays between the explosives, speed of a burning front of the explosives, discrepancies between the blast plan and the actual blast, and/or unsuccessful detonation of the explosives.

* * * * *